US006761354B2

(12) United States Patent
Pavlovits

(10) Patent No.: US 6,761,354 B2
(45) Date of Patent: Jul. 13, 2004

(54) THREE-DIMENSIONAL PUZZLE GAME AND METHOD FOR ASSEMBLING THE SAME

(75) Inventor: Ivan Pavlovits, Los Angeles, CA (US)

(73) Assignee: AA Studio, Inc., Los Angeles, CA (US)

( * ) Notice: Subject to any disclaimer, the term of this patent is extended or adjusted under 35 U.S.C. 154(b) by 0 days.

(21) Appl. No.: 10/351,060

(22) Filed: Jan. 24, 2003

(65) Prior Publication Data

US 2003/0137106 A1 Jul. 24, 2003

Related U.S. Application Data

(60) Provisional application No. 60/351,527, filed on Jan. 24, 2002.

(51) Int. Cl.[7] ..... A63F 9/12

(52) U.S. Cl. ..... 273/156; 273/157 R

(58) Field of Search ..... 213/157 R, 156; 434/172, 171, 176; 446/127

(56) References Cited

U.S. PATENT DOCUMENTS

| | | | | | |
|---|---|---|---|---|---|
| 490,689 | A | | 1/1893 | Thurston | |
| 1,880,130 | A | * | 9/1932 | Goldbach | 273/156 |
| 2,875,531 | A | | 3/1959 | Mansfield | |
| 3,100,642 | A | * | 8/1963 | Goldstein | 273/157 R |
| 3,171,214 | A | | 3/1965 | Sutherland | |
| 4,487,585 | A | | 12/1984 | Goldwasser | |
| 4,666,163 | A | * | 5/1987 | Hirschfeld | 273/157 R |
| 4,715,605 | A | | 12/1987 | Fritzman | |
| 5,149,098 | A | | 9/1992 | Bianchi | |
| 5,171,014 | A | * | 12/1992 | Hsieh | 273/157 R |
| 5,209,480 | A | * | 5/1993 | Katz | 273/157 R |
| 5,251,900 | A | | 10/1993 | Gallant | |
| 5,314,183 | A | | 5/1994 | Schoen | |
| 5,407,201 | A | | 4/1995 | Whitehurst | |
| 5,479,732 | A | | 1/1996 | Burtch et al. | |
| 5,525,060 | A | * | 6/1996 | Loebner | 434/171 |
| 5,600,910 | A | * | 2/1997 | Blackburn | 273/157 R |
| 5,608,977 | A | | 3/1997 | Burtch et al. | |
| 5,711,524 | A | | 1/1998 | Bauer et al. | |
| 5,743,741 | A | | 4/1998 | Fife | |
| 5,752,701 | A | | 5/1998 | Kao | |
| 5,860,650 | A | | 1/1999 | Scobbie et al. | |
| 6,439,945 | B1 | * | 8/2002 | Liu | 273/156 |

* cited by examiner

*Primary Examiner*—Steven Wong
(74) *Attorney, Agent, or Firm*—Kelly Lowry & Kelley, LLP

(57) ABSTRACT

A three-dimensional puzzle game includes a plurality of puzzle elements each having a connector, such as a slot or tab, for removable connection to one another. Each connector has a problem or answer indicia associated therewith, whereby the three-dimensional object is constructed by mating the relevant problem tab or slot of one puzzle element with the corresponding answer tab or slot of another puzzle element.

10 Claims, 9 Drawing Sheets

44
50
40
38
48
54
52
46
HEALTHFOOD
STORE 12
18
16
14
Helsinki
Paris
TURKEY
FRANCE
38
42
48
46
Dublin
Istanbul
IRELAND
FINLAND

THREE-DIMENSIONAL PUZZLE GAME AND METHOD FOR ASSEMBLING THE SAME

RELATED APPLICATION

The present application claims priority from U.S. Provisional Application Serial No. 60/351,527, filed Jan. 24, 2002.

BACKGROUND OF THE INVENTION

The present invention generally relates to puzzles. More particularly, the present invention relates to a three-dimensional puzzle game requiring assembly of a variety of puzzle pieces to form self-standing structures in an educational manner.

A puzzle is a toy that tries the ingenuity and taxes the patience of a player. A puzzle game usually involves a selection and sequential assembly of a plurality of polygonal shape pieces of varying contour to recreate an original image about a flat sheet board. Such puzzles are typically referred to as jigsaw puzzles.

More recently, there have developed a number of different types of three-dimensional jigsaw puzzles. These are typically designed to be self-standing structures which have a plurality of walls, each of which essentially comprises a two-dimensional puzzle in and of itself. With this form of puzzle, the walls which form the structure must be joined in some effective manner. This is particularly true where the three-dimensional jigsaw puzzle is adapted to be assembled into a building-like structure when the walls are to be joined at the corners thereof.

While some three-dimensional puzzles rely upon the joining of mating and interlocking edges, similar to a two-dimensional jigsaw puzzle, in order to form the three-dimensional structure, yet others utilize locking pins and the like.

Yet other three-dimensional self-standing puzzle structures utilize planar puzzle pieces having dovetail joints at edgewise sections for interlocking engagement with complimentary, edgewise, dovetail joints of adjacent puzzle pieces. Other three-dimensional puzzles require assembly or disassembly of the puzzle in a specific sequence. The plurality of interlocking pieces must be manipulated in a prescribed sequence in order to solve the puzzle.

Past art has described a variety of two-dimensional puzzles and games which aid in learning the relationships of similar designs, etc. on planar surfaces, such as, matching games in which images, colors, words, etc. must be matched together to be correct or to solve a puzzle or riddle. However, such puzzles and games do not offer the challenge of assembling a three-dimensional structure, nor the educational process of manipulating three-dimensional structures in space. They do not require that the player understand three-dimensional geometrical relationships and are of little benefit in improving the coordination necessary for manipulating a three-dimensional object in space in relation to other like three-dimensional objects.

Accordingly, there is a continuing need for a three-dimensional puzzle utilizing educational matching or problem solving games in order to create a three-dimensional structure. Such a game puzzle should be capable of being solved by people of various skills and ages. Such a puzzle game should also preferably be multi-use in nature so that a single puzzle game can create more than one three-dimensional object, and as such capable of being taken apart and reassembled. The present invention fulfills these needs and provides other related advantages.

SUMMARY OF THE INVENTION

The present invention resides in a three-dimensional puzzle game which can be used to create three-dimensional objects of various size and complexity. The present invention is intended to assist the builder, typically children, in learning relationships of similar designs and presenting the challenge of presenting a three-dimensional structure. The present invention also serves an educational purpose in that constructing the three-dimensional object requires solving problems, matching, or providing correct answers to a given problem or query.

The three-dimensional puzzle game of the present invention generally comprises a plurality of puzzle elements each having at least one connector, usually a slot or tab. Typically, the corresponding tabs or slots of the puzzle elements are removably connected to one another. Indicia, in the form of a problem or answer, is associated with corresponding tab or slot connectors. The problem and answer may be selected from math, geography, chemistry, language, science, or color matching problems and answers, or any other educational problem.

The three-dimensional object is constructed by interconnecting the plurality of puzzle elements by matching the indicia of the corresponding connectors to form the three-dimensional puzzle. This comprises mating the relevant problem tab or slot of one puzzle element with the corresponding answer tab or slot of another puzzle element in order to construct the three-dimensional object.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings for purposes of illustration, the present invention resides in a puzzle used to build three-dimensional objects, including buildings, play sets, furniture, play houses, etc. of different scale.

Figure 1:
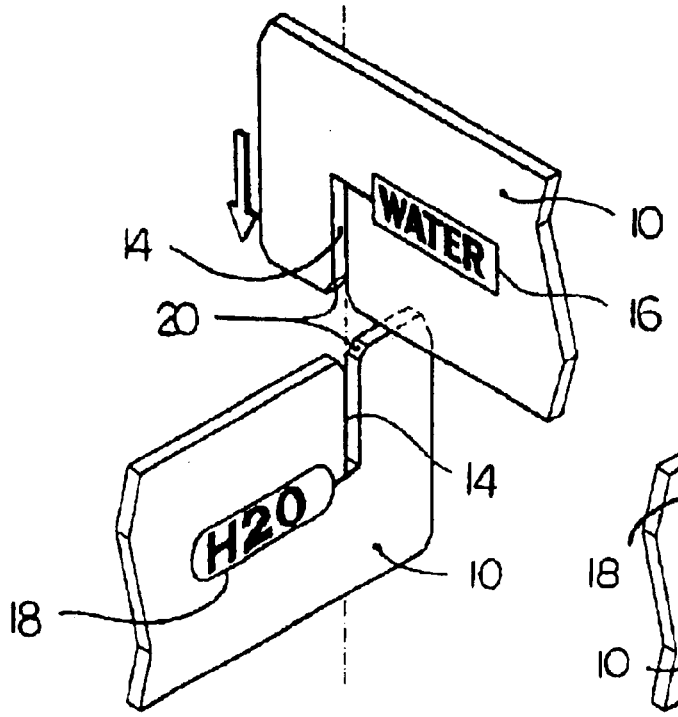
FIG. 1 is a partially fragmented perspective view of two puzzle element pieces used in accordance with the present invention, illustrating the solution of a chemistry matching problem to properly join the two puzzle elements together.
Figure 2:
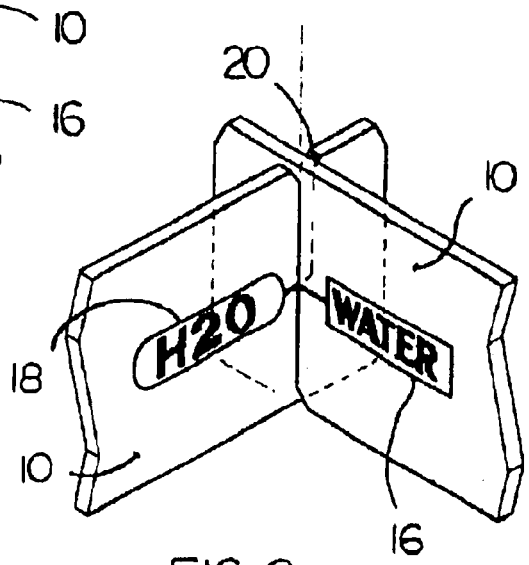
FIG. 2 is a partially fragmented perspective view of the two puzzle elements of FIG. 1 properly adjoined to one another.
Figure 3:
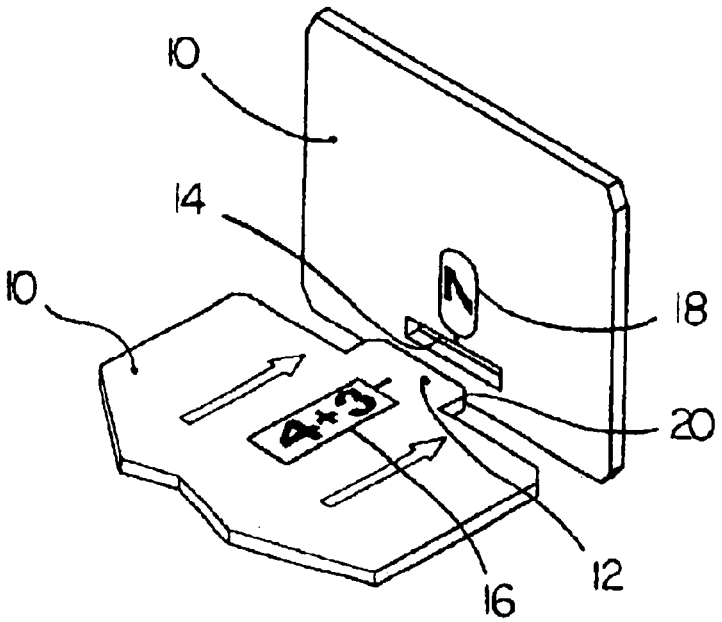
FIG. 3 is a partially fragmented perspective view of two puzzle elements, one puzzle elements having a tab insertable into a slot of the other to form connection between the two by solving a math problem.

With reference to FIGS. 1–3, the present invention utilizes a plurality of puzzle elements 10 comprised of puzzle board, cardboard, or other suitable material which is relatively inexpensive, capable of being imprinted upon or having illustrations attached thereto, and supporting a three-dimensional structure. The puzzle elements 10 of the present invention can be interconnected by inserting a tab 12 of one puzzle piece through a mating slot 14 of another puzzle piece, as illustrated in FIG. 3. Alternatively, a slot 14 of one puzzle element 10 is adjoined to another slot 14 of another puzzle element 10 in order to interconnect the puzzle elements 10. Typically, the tabs and slots 12 and 14 are not necessarily unique to one another and may be fitted to other elements 10.

Figure 4:
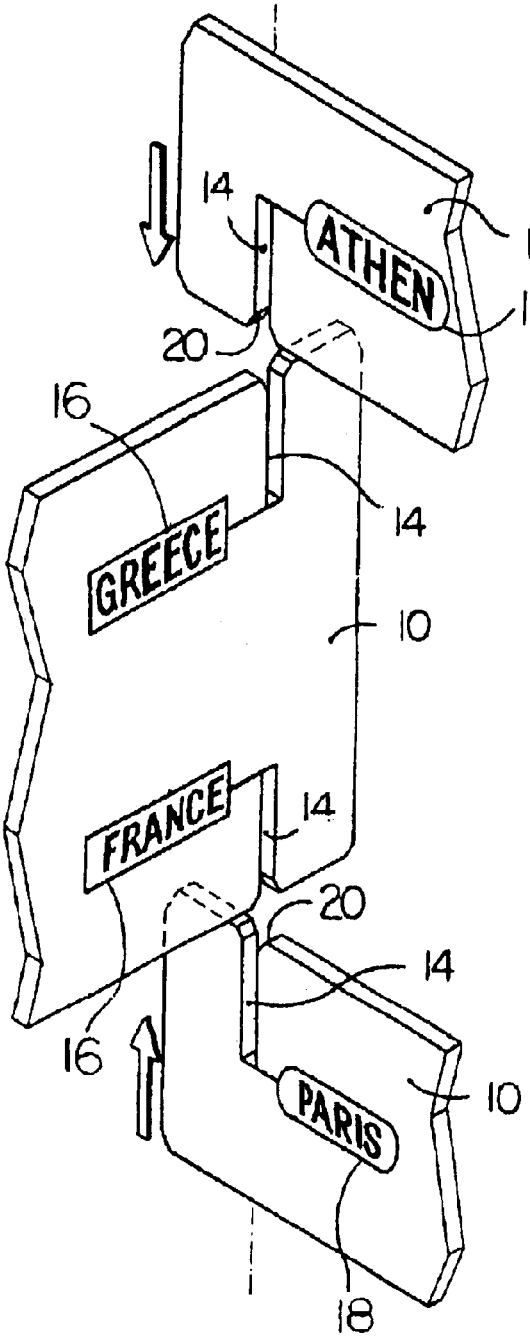
FIG. 4 is a partially fragmented perspective view of three puzzle elements used in accordance with the present invention, illustrating the solution of geography questions to properly join the puzzle elements together.
Figure 5:
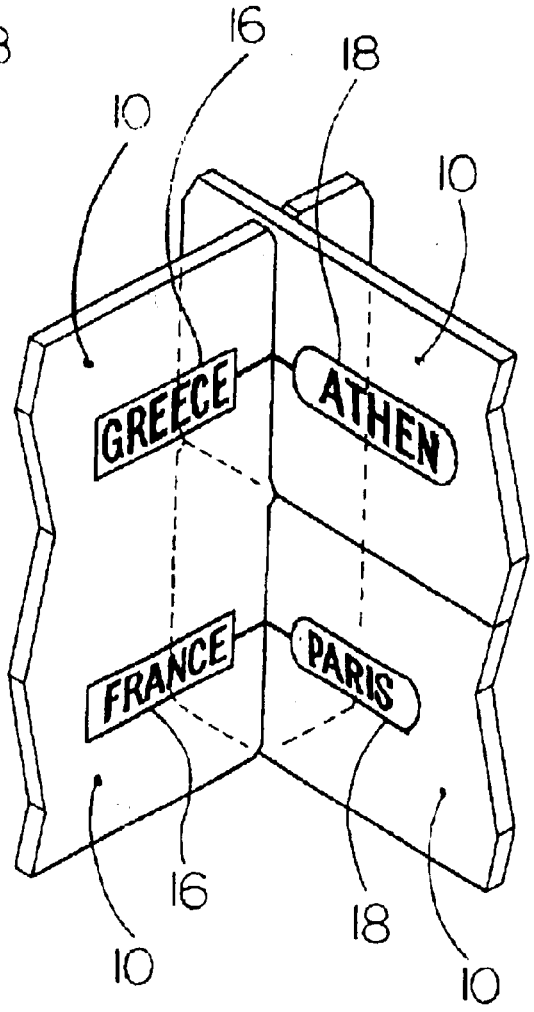
FIG. 5 is a partially fragmented perspective view of the puzzle elements of FIG. 4 properly joined to one another.

However, in order to recreate the intended three-dimensional structure, an educational problem 16 is illustrated adjacent to the tab 12 or slot 14, with the solution 18 depicted adjacent to the intended mating tab 12 or slot 14. Thus, a person solving the puzzle, typically a child, must be able to find the appropriate answer to the educational problem 16 at each junction point in order to create the three-dimensional object. The educational aspect may comprise math questions, as illustrated in FIG. 3, basic chemistry as illustrated in FIGS. 1 and 2, or geography in the form of capitals of the world, as illustrated in FIGS. 4 and 5. Other educational questions may be posed including state capitals, famous landmarks, lakes and rivers, color coordination, letter association, foreign language, etc.

The degree of difficulty within the educational problems can correspond to the degree of difficulty and complexity of the three-dimensional structure so that the puzzle can be created to suit a particular age or skill range. Of course, a relatively complex three-dimensional structure can also be created utilizing very basic and easy educational questions and associations so that younger children can create such complex structures by answering the educational queries presented which is at the child's educational level. Thus, the present invention presents a three-dimensional puzzle that educates in a given topic(s), as well as requiring the player to understand three-dimensional geometrical relationships, coordination, and manipulation of three-dimensional objects in space in relation to other like three-dimensional objects. This is both of interest to the parents, due to the educational aspect, as well as the child, as the creation of the three-dimensional structure and related play set is enjoyable.

In order to assist the child or problem solver in constructing the three-dimensional structure, the child often needs to know which pieces form the base of the structure. This may be provided by an illustration of the finalized structure in the puzzle kit, or directions to start at a certain answer or problem set. For example, the answers to given problems may be in numerical order, e.g. 1–20, such that solving the math puzzle 6—yields an answer of 1, the problem 16 in solution 18 slots being interconnected with one another to form a base of the structure. Another way of assisting the child in interconnecting the base elements of the three-dimensional structure to one another is to provide a list of the questions or problems to be solved in the order in which they should be solved and interconnected in order to properly create the three-dimensional structure. Of course, the invention does not require such assistance, instead requiring the more advanced problem solver to determine which elements comprise the base.

It will be noted by the reader that the slots or tabs illustrated in FIGS. 1–5 each include a beveled portion 20 at the open end of the slot which facilitate the insertion and removal of the adjoining puzzle piece. The puzzle piece elements 10 of the present invention, although designed to create particular three-dimensional structures, are also intended to be combined according to the imagination of the player to create variations in the three-dimensional structure and other structures. As such, the slots 14 are preferably not designed to mate exclusively with only one other slot or tab 12. However, in order to solve or reassemble the three-dimensional structure, it is necessary to properly solve all educational queries presented in order to exactly duplicate the intended three-dimensional structure. Although the present invention in a particularly preferred embodiment utilizes tabs 12 and/or slots 14 as connectors in order to removably connect the puzzle pieces 10 to one another, it will be appreciated by those skilled in the art that other connectors such as dovetail joints, locking pins, etc. could be used. Of particular importance to the present invention is the creation of a three-dimensional structure by solving the presented problems and answers. Accordingly, the puzzle elements 10 have corresponding problem and answer tabs 12 or slots 14, or other interconnecting means, are connected in a non-planar configuration in order to create a three-dimensional structure so that the child is presented with the challenge of solving an educational problem, as well as the challenge of assembling a three-dimensional structure.

Figure 6:
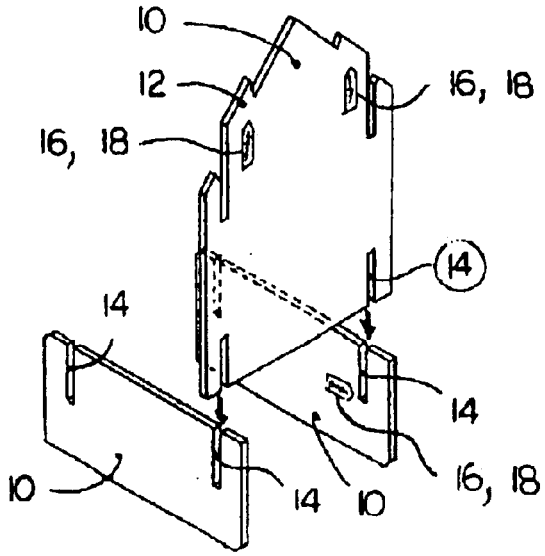
FIGS. 6–8 are partially exploded perspective views of a plurality of puzzle elements properly interconnected with one another to form a three-dimensional structure by solving educational problems.
Figure 7:
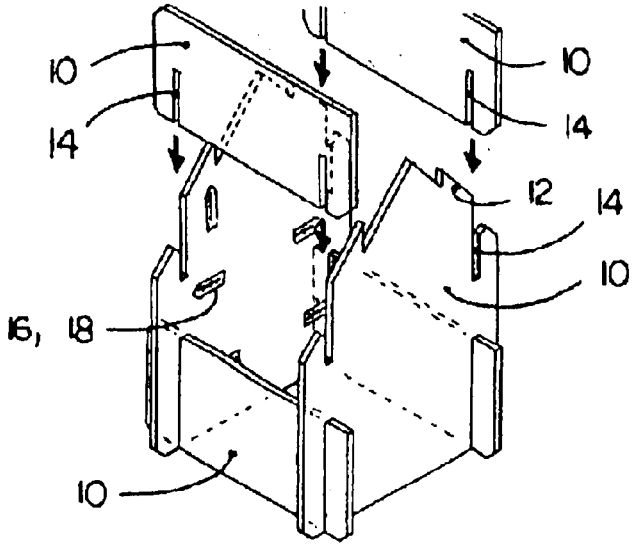
Figure 8:
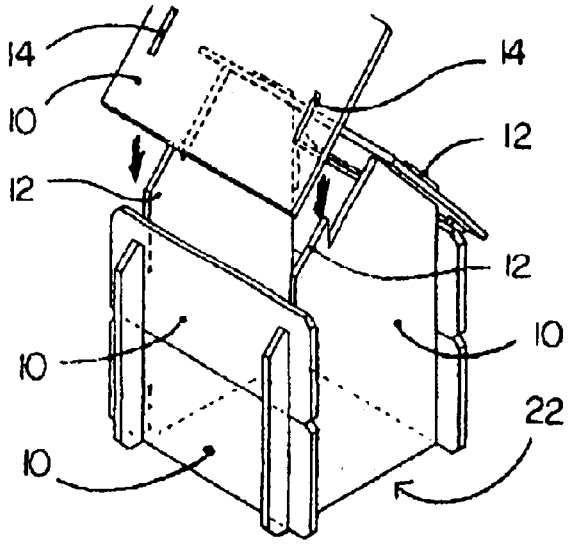

With reference now to FIGS. 6–8, a set of two-dimensional elements 10 is shown which when assembled, create a three-dimensional house structure 22. Such elements 10 include front and back elements of the house structure, roof elements, side elements, base elements, fence elements, etc. The various elements illustrated in FIG. 6 are assembled according to the educational query and answer 16 and 18 presented and adjoining the slots 14 in a cross-wise manner with a corresponding slot 14 of another puzzle element 10, or tab 12, in order to form the three-dimensional house structure 22.

Figure 9:
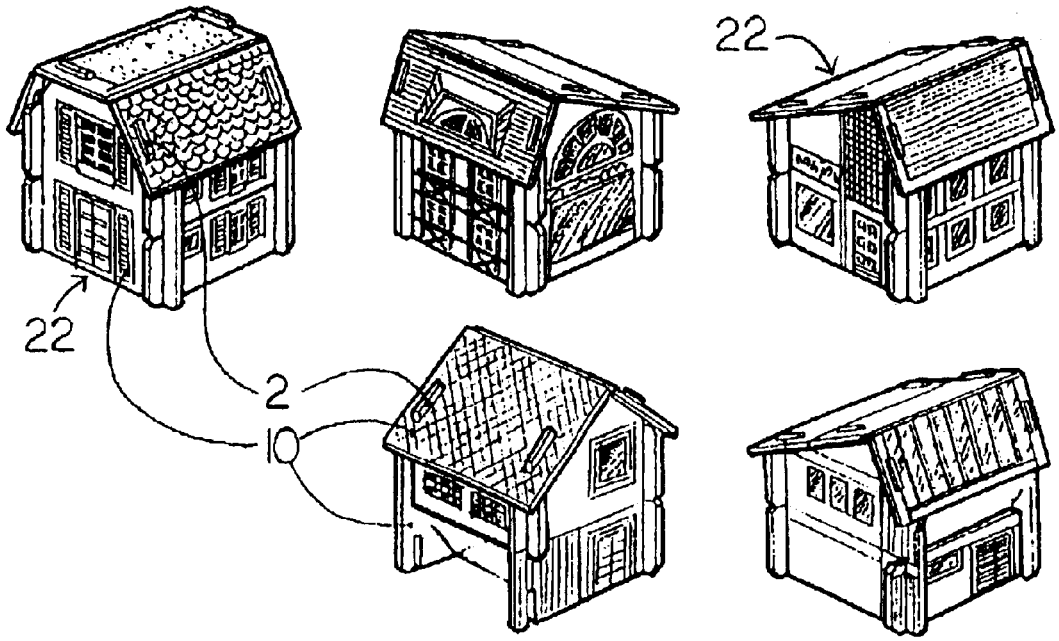
FIG. 9 illustrates a series of three-dimensional structures having interchangable parts.

With reference to FIG. 9, several house-like structures are shown having interchangeable parts. Thus, a set of puzzle elements may be provided in which two different roofs may be applied to the house structure 22. Similarly, several house puzzle sets may be purchased, each one of which has educational query and answers that when associated correctly form a particular three-dimensional housing structure, but having interchangeable parts such that the player can place different side walls, roofs, etc. without necessarily having to associate the correct educational queries and responses in order to create varied three-dimensional structures. This is possible due to the uniformity of the size of slots 14 and tabs 12, as well as the fact that the formed joints are not adhered to one another.

Figure 10:
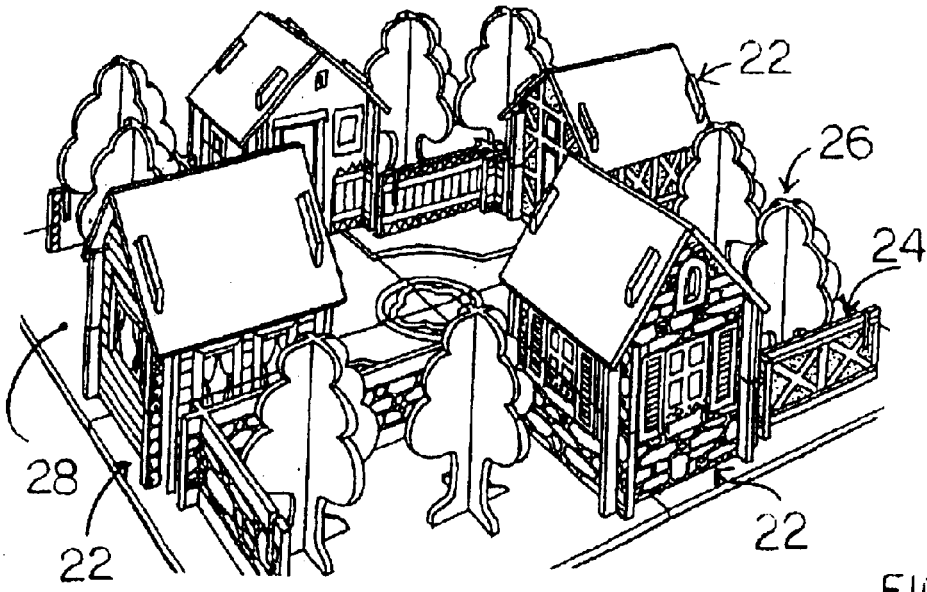
FIG. 10 is a perspective view of a number of three-dimensional structures formed in accordance with the present invention, and forming a play set in the form of a town placed on a two-dimensional background material.

With reference now to FIG. 10, several three-dimensional structures 22 may be provided in a single set or kit which form a particular motif setting, such as the town illustrated in FIG. 10. Other elements, such as fences 24, trees 26, etc. may be included in the set. Preferably, such additional items 24 and 26 will need to be created in the same manner as described above, and thus include puzzle elements 10 which are interconnected according to problem solving and the like in order to exactly replicate the depiction of the town. Two-dimensional drawings may be provided to the player so that the player can see what the final three-dimensional object or set is to look like from the various perspectives. A two-dimensional base 28 may be provided and having imprinted indicia thereon which corresponds with the play setting, and which may also include slots or the like into which the three-dimensional structures 22–26 can be inserted. The two-dimensional play board 28 may illustrate streets, lawns, waterfalls, etc. in which the child's toy cars and action figures may be used as a play activity. As described above, the buildings and other three-dimensional objects may be modified, or repositioned upon the two-dimensional "landscape" to give variety to the set. Thus, the appearance of the three-dimensional structure buildings and set can be varied aiding a child in his or her constructive skills, color sense and coordination.

Figure 11:
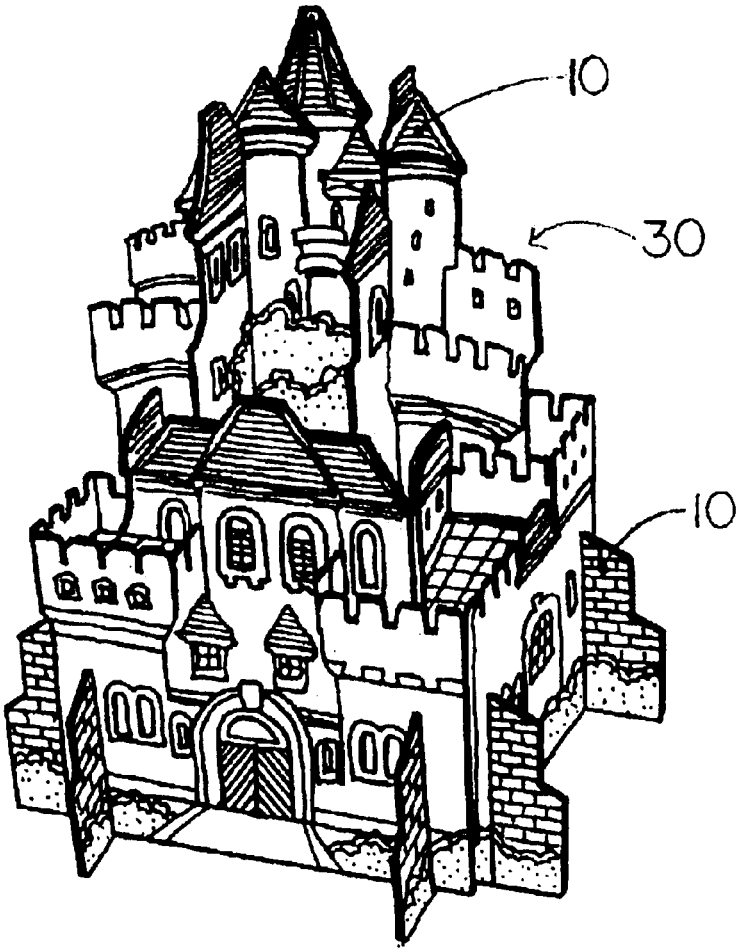
FIG. 11 is a perspective view of a three-dimensional castle built in accordance with the present invention.
Figure 12:
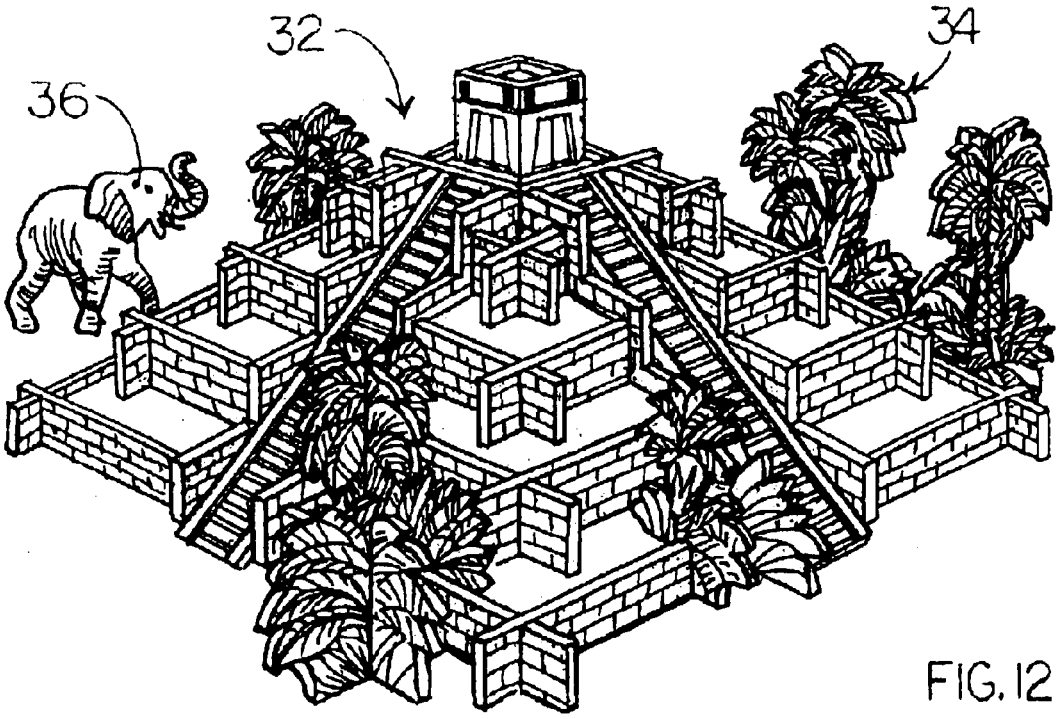
FIG. 12 is a perspective view of a three-dimensional jungle pyramid constructed in accordance with the present invention.
Figures 13A, 13B, 13C, 13D:
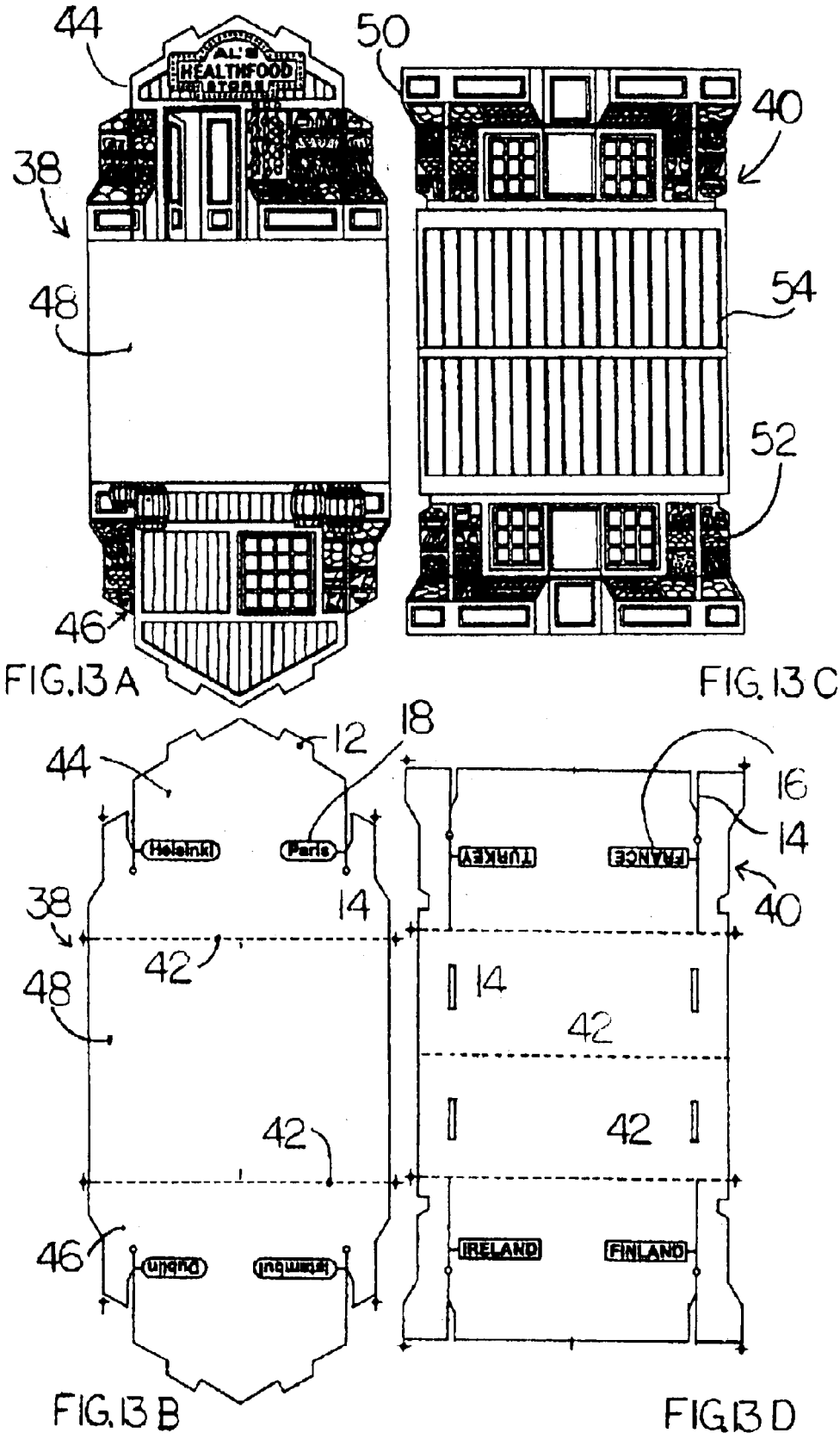
FIGS. 13A–D are top and bottom views of flat puzzle elements having folds or hinges.
Figure 13E:
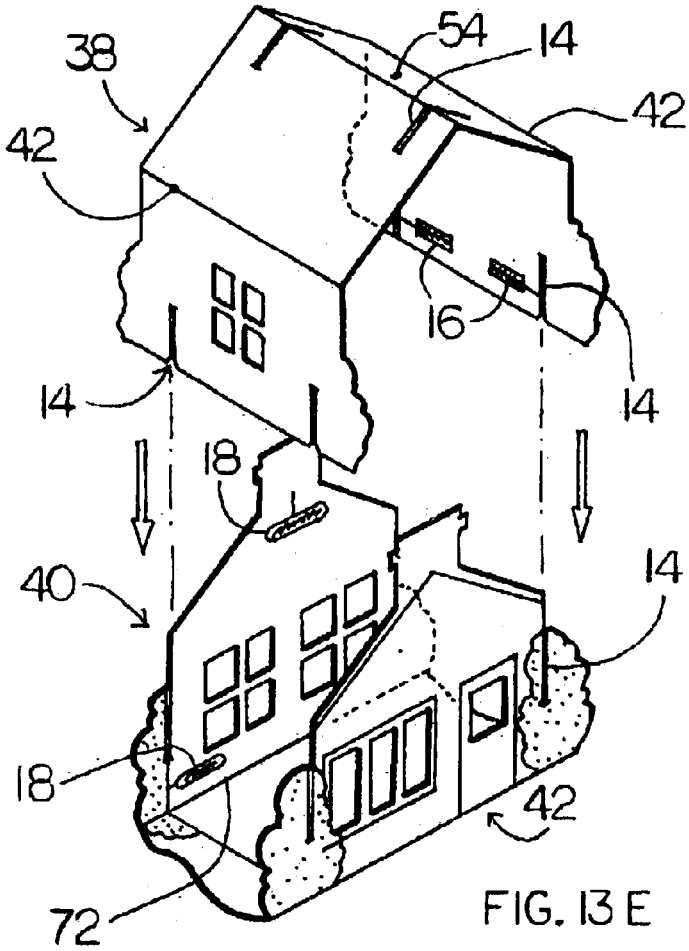
FIGS. 13E–H are perspective view of puzzle elements which have been folded and interconnected in accordance with the present invention to form three-dimensional buildings.
Figure 13F:
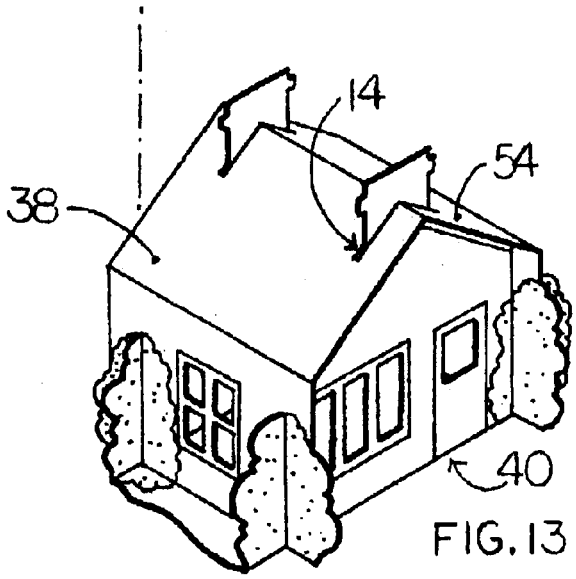
Figure 13G:
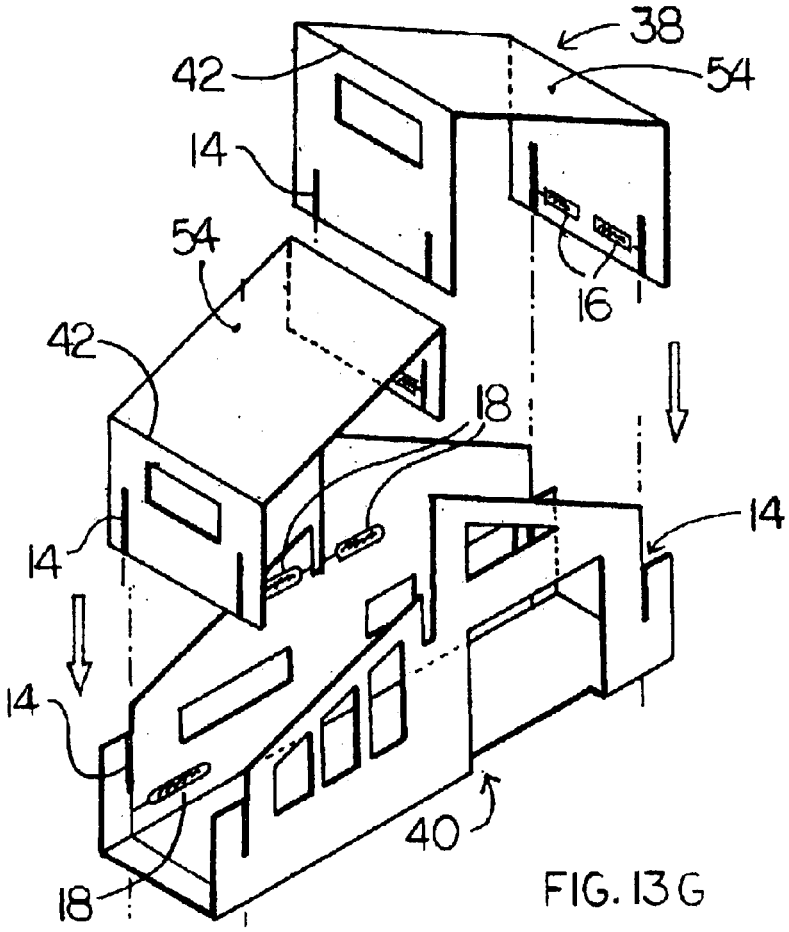
Figure 13H:
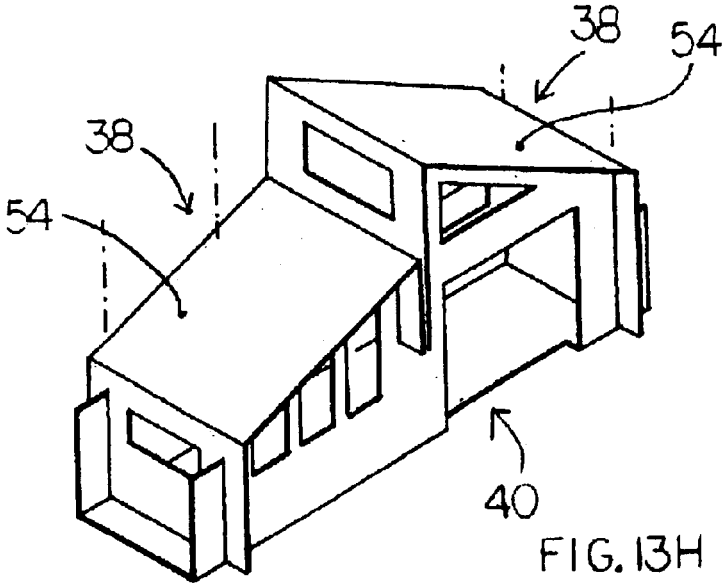

With reference now to FIG. 11, a much more complex castle 30 three-dimensional object is illustrated. Thus, it will be readily apparent to one skilled in the art that the present invention can be adapted to players of varying ages and skill level. FIG. 12 illustrates a pyramid three-dimensional object 32 which includes integral trees or bushes 34 and standalone toys such as the illustrated elephant 36.

Typically, the puzzle elements 10 are sold in a sheet and perforated so as to be removed by the player. Only one surface of the two-dimensional element 10 may contain illustrations or coloring which when assembled correctly provide continuity to the three-dimensional object. It is conceivable that an opposite side of the two-dimensional element 10 be decorated with a different motif and the puzzle elements 10 used to construct a second three-dimensional object. Preferably, the educational problem and answer connectors would be utilized in order to create the different three-dimensional objects. For example, to create a first three-dimensional object, math problems would be solved. However, using the imprinted motif on the opposite side of the puzzle elements 10, a different educational problem, such as geography, would be utilized to create the second object.

Although a great number of puzzle elements 10 may be included in the set to build a three-dimensional object 22 of considerable size, due to the fact that the puzzle elements 10 are flat, the object 22 can be disassembled and the puzzle elements 10 stored in a relatively small space.

In another particularly preferred embodiment, illustrated in FIG. 13, the puzzle elements 38 and 40 are constructed as a flat and planar piece. However, the puzzle elements 38 and 40 include living hinges or are otherwise adapted so as to be moved between planar and non-planar positions to enable the puzzle piece 38 and 40 to be pivoted and moved into a three-dimensional structure. A first three-dimensional structure is formed from puzzle element 38 and includes a front 44, back 46 and floor 48 portion such that the front and back 44 and 46 can be pivoted upwardly with respect to the floor 48. The other puzzle element 40 includes side walls 50 and 52 as well as a roof structure 54 which can be pivoted and attached to the pertinent portions of puzzle element 38 by solving the geography matching problems, or other answer-problem types, to create a building. FIGS. 13E–H illustrate the construction of two buildings utilizing exemplary foldable puzzle elements 38 and 40 which when folded at the hinges 42 to create the appropriate walls, floor, roofs, etc. can be interconnected according to the present invention by matching the questions or problems 16 and interconnecting the appropriate slots 14 or tabs. Providing such puzzle elements 38 and 40, which can be stored in a co-planar or flat configuration, but folded to non-planar positions to interconnect the pieces 38 and 40 to create buildings it is particularly convenient and provides variety to the types building constructions which can be offered.

The puzzle elements 10 of the present invention can be of various sizes and used to create towers, famous buildings, landmarks, airplanes, boats, space ships, etc.

Figure 14A:
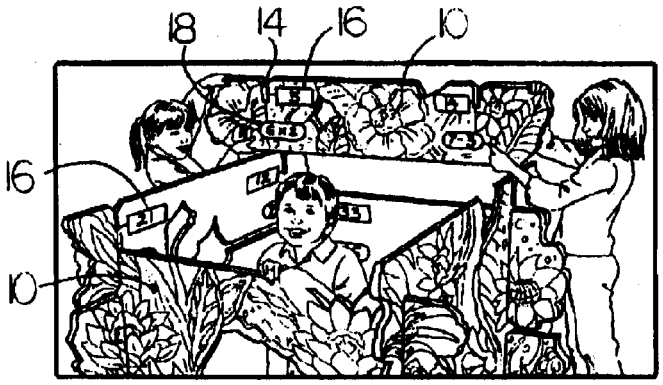
FIG. 14A is a partially fragmented perspective view illustrating the construction of a play house using puzzle elements in accordance with the present invention.
Figure 14B:
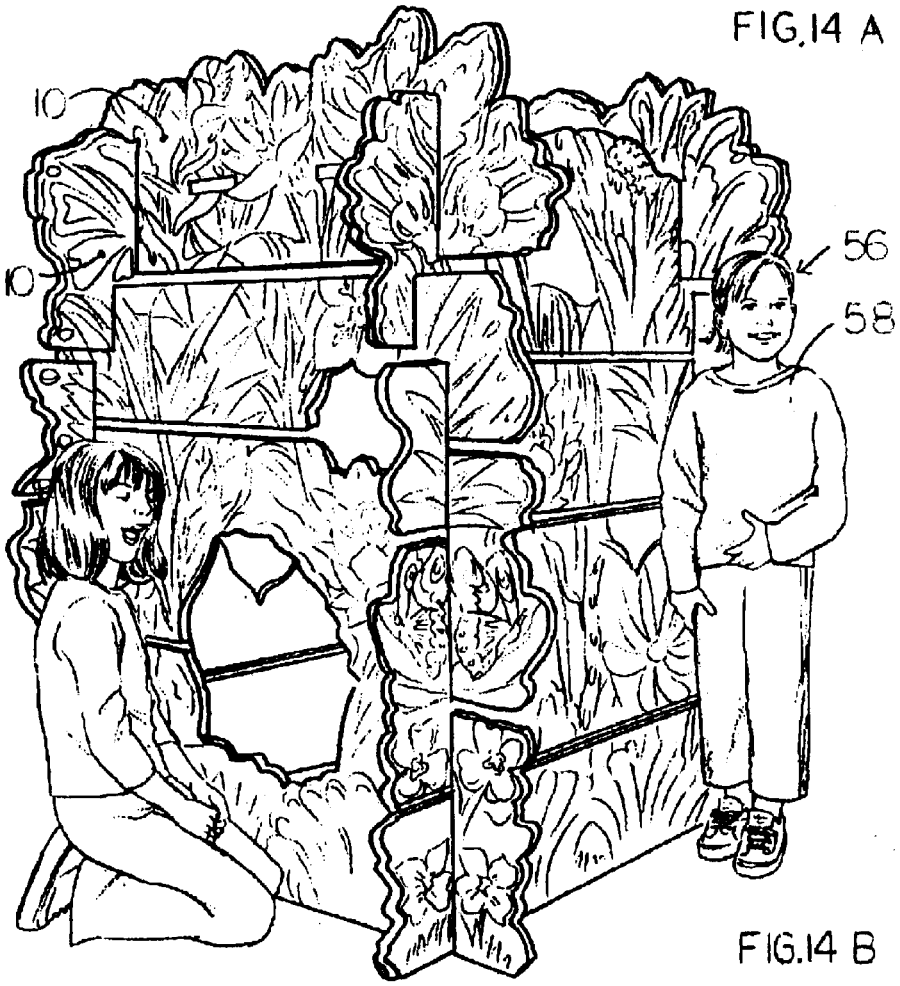
FIG. 14B is a perspective view of a finished play house constructed in accordance with the present invention.

With reference now to FIGS. 14A and 14B, although the previous embodiments illustrated have been described as pertaining to play sets and buildings on a rather small scale, it should be understood that the puzzle elements 10 of the present invention can also be used to create rather large structures, such as the illustrated play house 56. Such puzzle pieces 10 are preferably comprised of E.V.A. foam, or other such durable material. The large play house may require the assistance of adults to create. However, children 58 of a sufficient age may be able to create their own play house utilizing the puzzle elements of the present invention. It is also contemplated that such a play house could be accompanied with a small-scale version of the play house which the child could assemble while the adult assembles the larger play house.

Thus, it will be appreciated by the reader that the present invention can be used to create buildings, kiosks, trees, fences, elements of nature, various play sets, and even structures of enlarged scale. As the puzzle elements have dry joints only, the structures are easily disassembled for storage and future play. Thus, relatively large and complicated structures or play sets can be sold and stored in relatively small packages. Aside from serving as a three-dimensional puzzle, the present invention also serves to educate the player during the assembly process.

Although several embodiments have been described in detail for purposes of illustration, various modifications may be made without departing from the scope and spirit of the invention. Accordingly, the invention is not to be limited, except as by the appended claims.

What is claimed is:

1. An educational three-dimensional puzzle game, comprising:

at least three puzzle elements, each element having at least one slot or tab, the slots of each puzzle element being non-specific in configuration so as to be capable of receiving tabs of a plurality of the puzzle elements, wherein each slot and tab has associated therewith a problem or answer, whereby a three-dimensional object of predetermined configuration is constructed by mating the relevant problem tabs or slots of each of the puzzle elements with the corresponding correct answer tab or slot of the puzzle elements element in a non-planar fashion.

2. The puzzle game of claim 1, wherein the corresponding tabs or slots of the puzzle elements are removably connected to one another.

3. The puzzle game of claim 1, wherein the problem and answer is selected from the group consisting of math, geography, chemistry, language, science, or color problems and answers.

4. The puzzle game of claim 1, wherein at least one of the puzzle elements is comprise multiple segments which are movable between co-planar and non-planar positions.

5. The puzzle game of claim 1, wherein the three-dimensional object is selected from: a playset, a building, a vehicle, a landmark, furniture, an element of nature, and an animal.

6. An educational three-dimensional puzzle game, comprising:

at least three puzzle elements, each element having at least one slot or tab, wherein each slot and tab has associated therewith a problem or an answer selected from the group consisting of math, geography, chemistry, language, science, or color problems and answers;

whereby mating the relevant problem tabs or slots of each of the puzzle elements with the corresponding correct answer tab or slot of the puzzle elements in a non-planar fashion constructs a three-dimensional object of predetermined configuration selected from: a playset, a building, a vehicle, a landmark, furniture, an element of nature, and an animal.

7. The puzzle game of claim 6, wherein the slots of the plurality of puzzle elements are configured so as to non-specifically removably connect with tabs of the puzzle elements.

8. The puzzle game of claim 6, wherein at least one of the puzzle elements is comprised of multiple segments which are movable between co-planar and non-planar positions.

9. An educational three-dimensional puzzle game, comprising:

at least three puzzle elements, each element having at least one slot or tab, the slots of each puzzle element being non-specific in configuration so as to be capable of removably receiving tabs of a plurality of the puzzle elements;

wherein each slot and tab has associated therewith a problem or an answer selected from the group consisting of math, geography, chemistry, language, science, or color problems and answers;

whereby mating the relevant problem tabs or slots of each of the puzzle elements with the corresponding correct answer tab or slot of the puzzle elements in a non-planar fashion constructs a three-dimensional object of predetermined configuration selected from: a playset, a building, a vehicle, a landmark, furniture, an element of nature, and an animal.

10. The puzzle game of claim 9, wherein at least one of the puzzle elements is comprised of multiple segments which are movable between co-planar and non-planar positions.

* * * * *

UNITED STATES PATENT AND TRADEMARK OFFICE

CERTIFICATE OF CORRECTION

PATENT NO. : 6,761,354 B2
DATED : July 13, 2004
INVENTOR(S) : Ivan Pavlovits

It is certified that error appears in the above-identified patent and that said Letters Patent is hereby corrected as shown below:

Column 6,
Line 66, the word "element" should be deleted after the word "elements".

Signed and Sealed this

Seventh Day of December, 2004

JON W. DUDAS
*Director of the United States Patent and Trademark Office*